US006105896A

United States Patent [19]

Westrich

[11] Patent Number: 6,105,896

[45] Date of Patent: Aug. 22, 2000

[54] METHOD AND APPARATUS FOR WINDING AN ADVANCING YARN

[75] Inventor: Hermann Westrich, Wuppertal, Germany

[73] Assignee: Barmag AG, Remscheid, Germany

[21] Appl. No.: 09/180,881

[22] PCT Filed: Mar. 18, 1998

[86] PCT No.: PCT/EP98/01583

§ 371 Date: Apr. 19, 1998

§ 102(e) Date: Apr. 19, 1998

[87] PCT Pub. No.: WO98/42607

PCT Pub. Date: Oct. 1, 1998

[30] Foreign Application Priority Data

Mar. 25, 1997 [DE] Germany ..... 197 12 422
Sep. 3, 1997 [DE] Germany ..... 197 38 421

[51] Int. Cl.[7] ..... B65H 54/22

[52] U.S. Cl. ..... 242/474.5; 242/486.4; 242/474.4

[58] Field of Search ..... 242/474.6, 474.5, 242/486.4, 474.4

[56] References Cited

U.S. PATENT DOCUMENTS 5,029,762 7/1991 Behrens et al. .
5,100,072 3/1992 Behrens et al. .
5,407,143 4/1995 Nakai et al. .
5,489,067 2/1996 Nakai et al. ..... 242/474.5
5,526,995 6/1996 Westrich et al. ..... 242/474.5
5,558,286 9/1996 Suioka et al. .
5,775,610 7/1998 Kudrus ..... 242/474.6
5,816,513 10/1998 Spahlinger ..... 242/474.5

FOREIGN PATENT DOCUMENTS 0 374 536 11/1989 European Pat. Off. .
0 606 900 1/1994 European Pat. Off. .
0 768 271 4/1997 European Pat. Off. .
195 38 480 5/1997 Germany .
WO96/1222 1/1996 WIPO .

*Primary Examiner*—Donald P. Walsh
*Assistant Examiner*—Minh-Chau Pham
*Attorney, Agent, or Firm*—Alston & Bird LLP

[57] ABSTRACT

A package (17) is formed on a driven winding spindle (14, 15) that is mounted in cantilever fashion to a movable support (11). A contact roll (15) lies with a contact force against the circumference of the package. The contact roll is likewise mounted to a movable support (8). During the winding cycle, the center distance between the package and the contact roll is controlled by an evading movement of the contact roll or by a constant evading movement of the winding spindle as a function of the increasing package diameter. The constant evading movement of the winding spindle occurs at a variable speed. For the control, the speed is predetermined as a function of the diameter increase of the package.

22 Claims, 6 Drawing Sheets

METHOD AND APPARATUS FOR WINDING AN ADVANCING YARN

BACKGROUND OF THE INVENTION

The present invention relates to a method and apparatus for winding a continuously advancing yarn into a yarn package, wherein the package is formed on a driven winding spindle be mounted in cantilever fashion on a moveable support such as a rotatable turret, and wherein a moveable contact roll rests on the surface of the package being formed.

During such winding processes, the increase in the diameter of the package as the package builds is accommodated by an evading movement of the package or the contact roll. Also, the contact force between the package and the contact roll is predetermined by a hydraulic or pneumatic biasing force. Since the center distance between the contact roll lying against the circumference of the package and the package likewise affects the contact force, the change of the center distance causes the contact force to change at the same time. This gives rise to the problem that on the one hand a predetermined contact force is always present between the contact roll and the package and that on the other hand, however, the package diameter is allowed to increase unimpeded.

EP 0 374 536 and corresponding U.S. Pat. No. 5,029,762 disclose a method and a winding or takeup machine, wherein the evading movement of the winding spindle receiving the package during a winding cycle is controlled as a function of the position of the contact roll. In this instance, the evading movement of the winding spindle may occur in steps or continuously. Since the contact force between the contact roll and the package depends on the relative position between the contact roll and the package, it is not possible to avoid a change of the contact force during the winding cycle.

U.S. Pat. No. 5,407,143 discloses a takeup machine, wherein the rotational movement of a spindle turret with a winding spindle projecting therefrom is controlled in such a manner that the contact force between a contact roll and the package maintains a predetermined desired value. In this instance, an adjusting device for changing the center distance is simultaneously used for controlling the contact force. This produces unwanted changes of the contact force due to stick-slip effects.

WO 96/01222 discloses a method and a takeup machine, wherein the rotational movement of the spindle turret occurs as a function of the angular position of the winding spindle. From the correlation between the angular position of the winding spindle on the spindle turret and the diameter of the package, one may conclude the associated angular position from the changing diameter. Since the contact roll resting against the package is stationary, the increase of the package causes an increase of the contact force between the contact roll and the package. In addition, the method may lead—in particular in the case of soft packages—to an overtraveling of the spindle turret, so that the contact between the contact roll and the package is totally lost.

Likewise, the method disclosed in DE 195 38 480 has the disadvantage that the stepwise rotational movement of the spindle turret as a function of the angular position of the winding spindle causes in the course of the winding cycle a discontinuous change of the contact force between the package and the contact roll, which is caused by the increase of the package diameter. In the known method, a time is predetermined, after which the angular velocity of the spindle turret is periodically computed as a function of the position of the spindle turret. Since the chronological diameter increase of the package requires a substantially faster change of the angular velocity of the spindle turret at a small package diameter in comparison with a large package diameter, fluctuations in the contact force are incurred at the beginning of the winding cycle.

It therefore an object of the invention to further develop a method of winding a continuously advancing yarn as initially described as well as a takeup machine for carrying out the method such that the yarn is wound on the package during the entire winding cycle with a predetermined contact force or a predetermined contact force profile at a substantially constant speed of advance of the yarn.

SUMMARY OF THE INVENTION

The above and other objects and advantages of the present invention are achieved by the provision of a winding method and apparatus which includes the steps of winding the advancing yarn onto a tube which is coaxially mounted on a driven winding spindle which in turn is mounted on a moveable support, and so as to form a yarn package. The circumferential surface of the package is engaged with a contact roll which is mounted on a second moveable support so that the contact force between the contact roll and the surface of the package can be varied by the position of the contact roll relative to the package. Also, the center to center distance between the winding spindle and the contact roll is controlled to accommodate the increasing diameter of the package. This control includes, during at least a portion of the winding of the package, controlling an evading movement of the winding spindle which increases the center to center distance at a speed determined as a function of a predetermined speed function which relates the speed of the evading movement to the momentary package diameter.

When winding a yarn at a substantially constant yarn speed, the chronological diameter increase is dependent on the respective package diameter. Thus, at a small package diameter, the outside diameter of the package will increase substantially faster than at a large outside diameter while winding the same amount of yarn per unit time. The diameter increase per unit time may therefore be considered a function of the outside diameter of the package. This diameter increase determines the change of the center distance between the package and the contact roll. The invention now establishes the correlation between the evading movement of the winding spindle for purposes of increasing the center distance between the contact roll and the package as well as the diameter increase of the package which is dependent on the package diameter. Consequently, the evading movement of the winding spindle occurs at a variable speed, which results from a predetermined speed function. In the course of a winding cycle, the speed function associates to each package diameter a certain speed which is dependent on the chronological diameter increase of the package. The special advantage of this method lies in that the contact force which is adjusted on the contact roll is independent of the evading movement for increasing the center distance between the package and the contact roll. The circumferential contact between the package and the contact roll will remain unchanged, as long as the speed of the evading movement is adapted to the diameter increase.

In cases, in which the package is guided by means of a movable support along a linear path of movement relative to the contact roll, an embodiment is particularly advantageous wherein, the evading movement of the winding spindle occurs at a speed which is proportionate to the diameter increase of the package during the winding cycle. Thus, the package is allowed to increase while the position of the contact roll remains unchanged, and while the adjusted contact force is maintained.

In cases in which the package is moved during the winding cycle along a curved path of movement relative to the contact roll, a further embodiment is particularly advantageous wherein, the evading movement of the winding spindle occurs at a speed, which is disproportionate to the diameter increase. As a result thereof, the speed of the evading movement may likewise lead to a change of the contact force. In the case of a movable contact roll, the contact force between the package and the contact roll is determined substantially by the weight of the contact roll. Thus, the action of force of the contact roll is substantially dependent on its position relative to the package. Therefore, the contact force can be influenced and controlled in a simple manner during the winding cycle by the evading movement of the package. In particular, for the package buildup it will be advantageous, when the contact force is variable during the winding cycle. Each adjusted contact force may then be maintained constant by a corresponding speed of the evading movements.

A further advantage lies in that it is possible to influence the looping of the yarn on the contact roll. The looping length of the yarn on the contact roll is described a so-called "print length." The print length thus defines the length from the point of first contact of the yarn on the contact roll to the point of deposit of the yarn on the package. The print length defines the guidance of the yarn on the contact roll, and it directly influences the buildup of the package. Thus, for example, a too short print length increases the risk of sloughs on the package. In these cases, the traversed yarn drops from the package edge at the end of the package. The speed of the evading movement can therefore be predetermined in such a manner that the contact roll always assumes a position, in which the print length on the contact roll is constant.

In a particularly advantageous variant of the method, the winding spindle is moved at a speed which is proportionate to the diameter increase of the package in stages of the winding cycle and, thus, leads to an unchanged position of the contact roll, or which is however in stages disproportionate to the diameter increase of the package, so that the position of the contact roll changes with respect to influencing the contact force or the print length. This variant of the method is especially advantageous for purposes of maintaining certain contact force profiles during the winding cycle. Likewise, this variant of the method permits adjustment of defined print lengths on the contact roll during the winding cycle.

During the winding of a yarn to a package, the winding cycle is characterized by a winding time, in which the package is fully wound. The winding time is dependent on the winding speed, the yarn denier, and the package buildup. At any point of time of the winding cycle, the package has a certain diameter. This allows to associate a certain package diameter to each winding time. With that, it is possible to apply the method variant wherein the control of the evading movement of the winding spindle occurs as a function of the winding time. This variant is advantageous in processes, in which the winding parameters and the yarn type remain unchanged. The control of the evading movement of the winding spindle may be realized as a mere time control. The speed function underlying the control represents the correlation between the speed of the evading movement and the winding time.

In an especially advantageous variant of the method, the evading movement of the winding spindle is controlled as a function of the package diameter. As a result of combining package diameter and winding time, it is possible to directly determine parameters that change during the process and thus to exactly predetermine the speed of the evading movement.

To continuously determine the diameter of the package being wound, it will be advantageous to determine to this end the position of the support of the contact roll relative to the machine frame or the position of the support of the winding spindle relative to the machine frame. Since the contact roll and the package are in a constant circumferential contact, it is possible to compute alone from the geometric data for each package diameter the corresponding position of the contact roll or the corresponding position of the winding spindle.

Simultaneously known are thus the position of the support of the contact roll, for example, a rocker arm, or even the position of the support of the winding spindle, for example, likewise a rocker arm, in their relative position to the machine frame. This correlation between package diameter and position of the support can be input as a master curve into a control device of the takeup machine. Thereafter, it will be possible to determine the respective package diameter alone from measuring the position of the support. Thus, the momentary diameter increase is known at the same time, so that the speed of the evading movement can be controlled accordingly.

The package diameter may be determined by the ratio of the rotational speed of the contact roll and the rotational speed of the winding spindle. This has the advantage that no additional devices are needed for determining the package diameter. To maintain the yarn tension substantially constant during the winding, the winding speed is controlled with the aid of the contact roll. In so doing, the rotational speed of the contact roll is continuously determined and compared with a predetermined desired value. The desired value predetermines a constant rotational speed of the contact roll. When the actual rotational speed deviates from the desired rotational speed, the drive of the winding spindle is controlled in such a manner that the desired rotational speed adjusts itself on the contact roll. These data which are already available in a takeup machine may be used in this variant of the method for determining the package diameter at the same time.

In a particularly advantageous variant of the method as the speed of the evading movement is computed in advance from a parameter characterizing the chronological diameter increase of the package and the package diameter. The correlation can be represented by the following mathematical equation:

$$v=(K^2/2)(1/D),$$

where v is the speed, K the diameter increase parameter, and D the package diameter.

The thus predetermined speed of the evading movement permits the contact force to be kept substantially constant during the winding cycle. The speed function results from $F_v=v(D)$, i.e., a certain speed v results for each package diameter that is wound during the winding cycle.

According to the variant of the method, it is possible to determine the parameter K, which characterizes the chronological diameter increase of the package, during the winding cycle while the support of the winding spindle is stopped.

To traverse during the winding cycle a contact force profile with a variable contact force, the variant of the method may be used with special advantage. Wherein, the position of the contact roll is included in the determination of the speed. The position of the contact roll may be defined, for example, by the angle of traverse cc of the movable support of the contact roll, which is constructed as a rocker arm. From the position of the contact roll and the package diameter, it is possible to compute, based on the geometric relation between the contact roll and the winding spindle, the contact force that is caused by the weight. The speed is then determined with the use of the package diameter, which corresponds to the computed contact force, and the increase in diameter.

Since the contact force between the contact roll and the package is substantially determined by the relative position of the contact roll to the package this relationship is particularly suited for determining the contact force and taking same as the basis for the control of the evading speed.

A particularly advantageous embodiment of the invention involves winding a continuously advancing yarn, which is changed automatically between a first and a second winding spindle by rotating a spindle turret. In this process, the center distance between the contact roll and the package is varied at the beginning of the winding cycle by the evading movement of the contact roll, while the support of the winding spindle is stopped. During this time the second winding spindle with a fully wound package is in a so-called parking station. While being there, the full package is removed from the winding spindle by a doffing device and replaced with an empty tube. Subsequently, the winding cycle continues in a range of transition such that the center distance is enlarged by the evading movement of the winding spindle. However, in the range of transition, the evading movement of the winding spindle is realized at such an accelerated speed that the contact roll returns to its initial position within a short time. The initial position of the contact roll represents the actual optimal working point of the takeup machine. This working point is therefore left only for the doffing time, so that it can thereafter be readjusted as quickly as possible. Subsequent to the range of transition, the winding cycle continues in a winding range by the constant evading movement of the winding spindle.

When dividing the winding cycle into a winding start range, a transitional range, and a winding range, it is possible to determine during the winding cycle in the winding start range the speed function that is decisive for the evading movement of the winding spindle in the winding range. In the winding start range, the support of the winding spindle (spindle turret) is stopped. In this phase, the increasing package diameter causes an evading movement of the contact roll. The contact roll will make way along a guide path that is defined by the support. When passing along this guide path, the weight component of the contact roll that acts upon the package surface will vary constantly. Thus, a certain contact force corresponds to each position of the contact roll.

In accordance with another specific embodiment of the invention, the actual values of the contact force are determined in the winding start range used as basis for the control of the evading movement of the winding spindle in the winding range. This advantageously permits compensation of weight tolerances of the contact roll and the support of the contact roll as well as of possible hysteresis forces which occur during the movement of the contact roll.

The speed of movement of the winding spindle during the winding range may be computed in advance from the winding parameters present during the winding start range. This offers the possibility of determining the chronological diameter increase in the winding range. From the known tube diameter and the package diameter that is continuously measured per unit time, it is possible to determine the amount of yarn that is deposited on the package per unit time, so that the diameter increase of the package and the parameter K are known. Thus, it is possible to compute in advance for the entire winding cycle the speed function, at which the evading movement of the winding spindle must be carried out in the winding range. In this case, the speed of the evading movement performed by the winding spindle is equal to the angular velocity of the spindle turret.

The evading movements of the winding spindle are effected by a drive, which drives the respective support, and which is variable in its speed. Preferably, the drive is an electric motor, which is activated by means of a control element for varying the drive speed. Depending on the type of support of the winding spindle, the drive may also be in the form of a pneumatic cylinder, pneumatic motor, or servo drive mechanism.

The takeup machine of the present invention is characterized in that it is possible to use signals that are generated for controlling the winding spindle speed simultaneously for controlling the evading movement of the winding spindle. By predetermining a speed function as a function of the package diameter or the winding time, the drive of the spindle turret is adjusted at any point of time of the winding cycle to the determined speed that momentarily corresponds to the rate of diameter increase.

To receive during the winding cycle a feedback of the controlled change in position of the spindle turret, the takeup machine preferably includes a position sensor for determining the position of the support for the contact roll or the winding spindle turret. In this case, the position of the support of the contact roll or the position of the spindle turret is constantly detected by a position sensor and supplied to the control device. Since as result of the geometric arrangement, only one package diameter corresponds to each position of the contact roll and to each position of the spindle turret, it is possible to make an adjustment between the control and the actual position.

The control device preferably includes a computing unit, which computes from the winding parameters supplied by the controller the speed function for controlling the speed of movement of the winding spindle turret. Thus during the winding cycle, the control performs a continuous computation of the speed function for controlling the spindle turret. The winding parameters, such as rotational speed of the contact roll and rotational speed of the winding spindle are continuously input to a computing unit of the control device. The computation may be conducted both continuously and in intervals, for example, in the case of predetermined diameter stages.

In accordance with an especially advantageous further development, the support of the contact roll is connected to a drive. It is thus possible to wind during the winding cycle in certain sections without a contact. Since the speed function of the spindle turret is known during the winding cycle, it is possible to exactly predetermine a target diameter of the package during the noncontacting winding. A cyclical raising of the contact roll from the package surface may also be of advantage in the case of heavily lubricated yarns, so as to be able to remove the lubrication film that builds up before the nip clearance. The drive of the support is constructed, for example, as a pneumatic cylinder.

BRIEF DESCRIPTION OF THE DRAWINGS

Further advantages of the method in accordance with the invention are described in the following with reference to an embodiment illustrated in the drawings, in which.

DETAILED DESCRIPTION OF THE PREFERRED EMBODIMENTS

Figure 1:
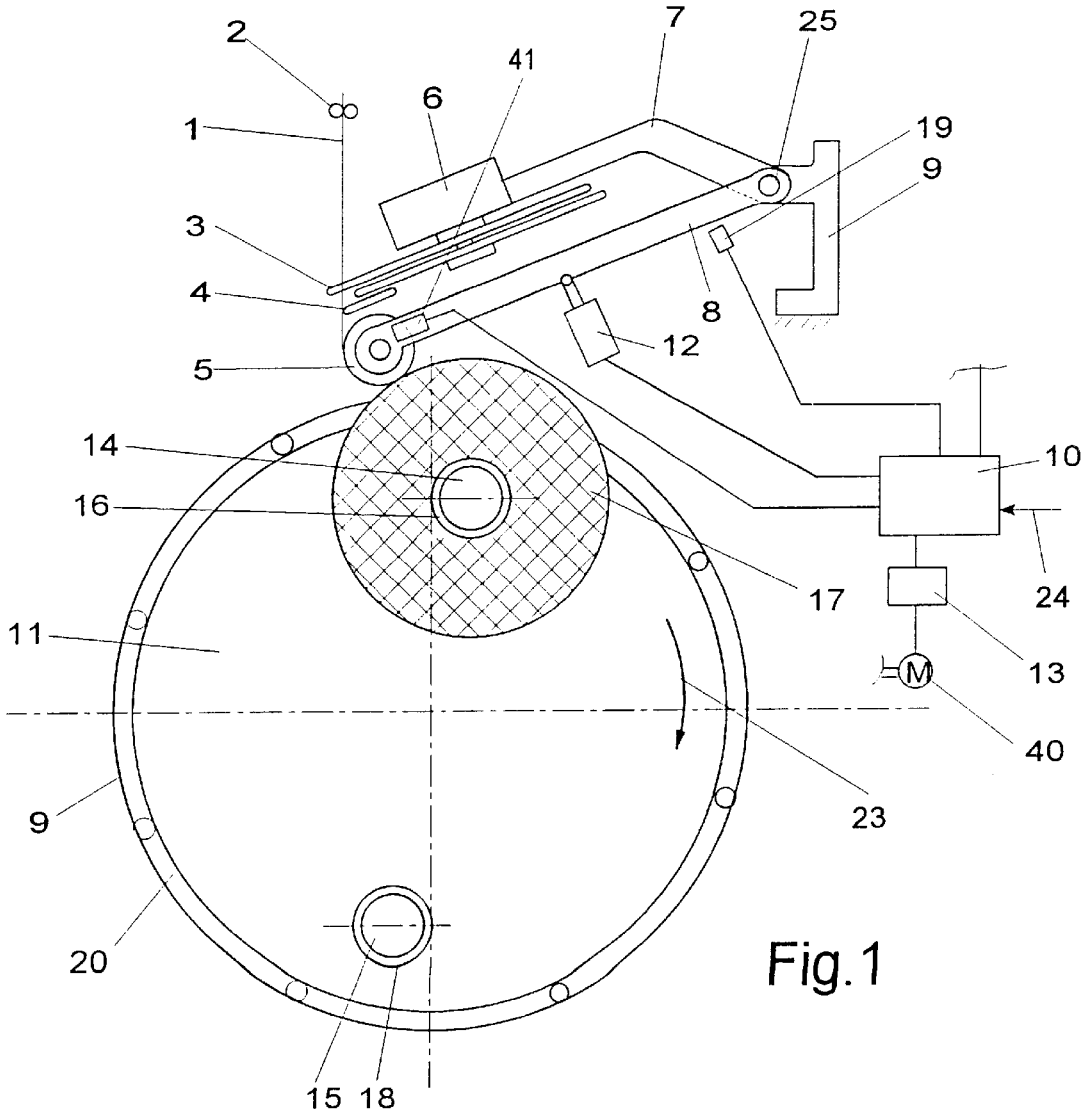
FIG. 1 is a side view of a takeup machine in operation.
Figure 2:
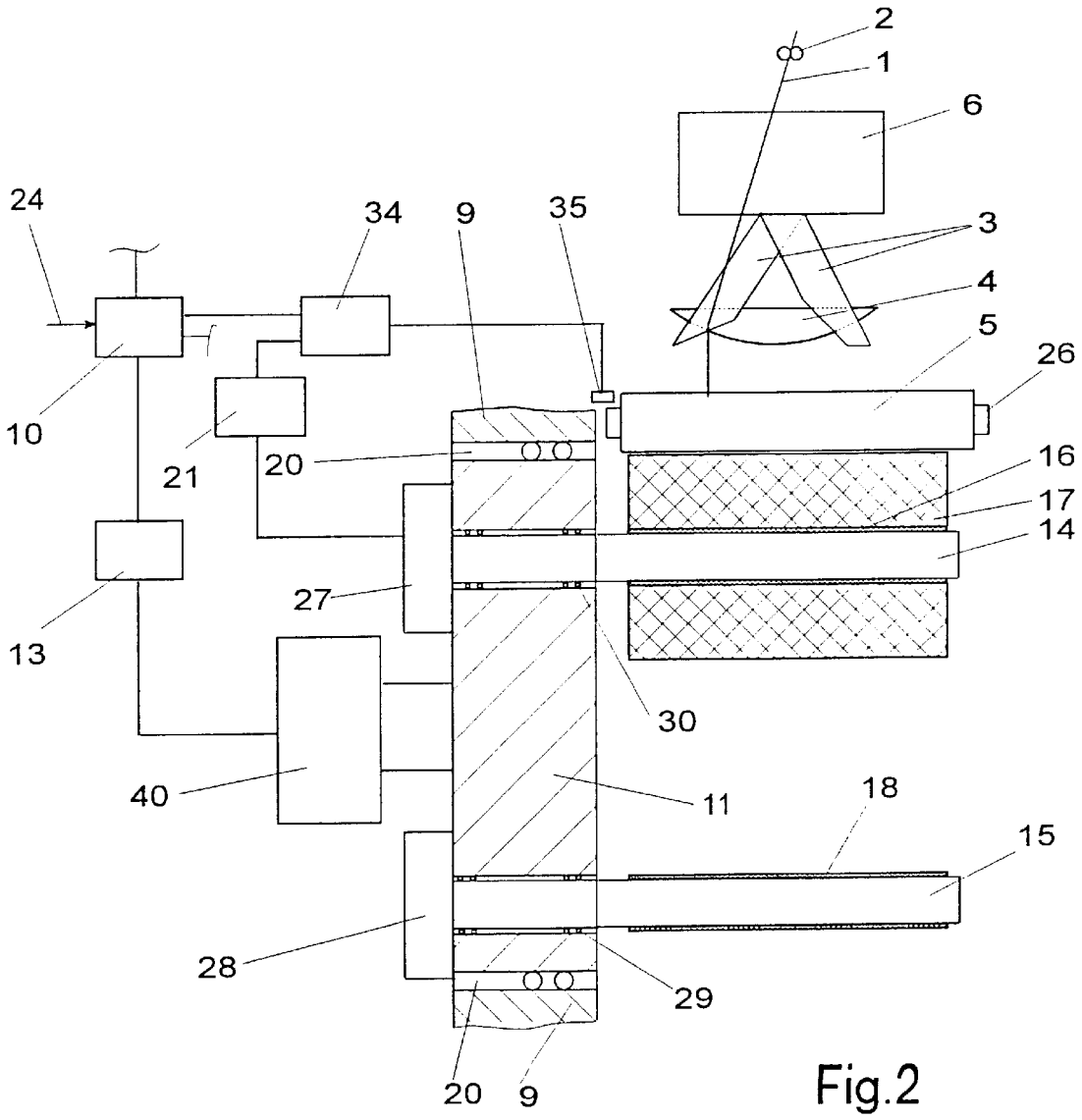
FIG. 2 is a front view of the takeup machine of FIG. 1 in operation.

The following is a joint description of an embodiment shown in FIGS. 1 and 2.

The takeup machine comprises a spindle turret 11 which is mounted for rotation by means of a bearing 20 in a machine frame 9. The spindle turret 11 is driven by an electric motor 40. In the spindle turret, two winding spindles 14 and 15, 180 degrees out of phase, are mounted in cantilever fashion for off-center rotation. As shown in FIG. 1, the winding spindle 14 is in its operating position in a winding range, and the winding spindle 15 in a standby position in a doffing range of the takeup machine.

A yarn 1 advances at a constant speed to the takeup machine. In this process, the yarn 1 is first guided by a yarn guide 2 which forms the apex of a traversing triangle. Thereafter, the yarn reaches a traversing mechanism. The traversing mechanism consists in this instance of a traverse drive mechanism 6 and rotary blades 3. The rotary blades 3 alternate in guiding the yarn 1 along a guide bar 4 within the limits of a traverse stroke. The yarn traversing mechanism is supported for movement on the frame 9 of the takeup machine. To this end, a support 7 is used, whose free end mounts the yarn traversing mechanism that is arranged for swinging movement with the other end in such a manner that the traversing mechanism can perform a movement perpendicular to itself and relative to a contact roll 5, i.e., a parallel displacement.

Downstream of the traversing mechanism, the yarn is deflected on the contact roll 5 at an angle of more than 90 degrees and subsequently wound on a package 17. The package 17 is formed on a winding tube 16. The winding tube 16 is mounted on the freely rotatable winding spindle 14. The winding spindle 14 with the winding tube 16 mounted thereon and the package 17 being formed thereon is in an intermediate winding range.

The winding spindle 14 is supported in the spindle turret 11 by means of a bearing 30. The winding spindle 14 is driven by a winding spindle drive 27, which may be, for example, a synchronous or an asynchronous motor. The winding spindle drive 27 is mounted to the spindle turret in alignment with the spindle 14. The winding spindle drive 27 is supplied with a three-phase current of controllable frequency by a frequency changer 21. The frequency changer 21 is controlled by a controller 34, which is activated by a rotational speed sensor 35. The rotational speed sensor 35 scans the rotational speed of contact roll 5. The controller 34 controls the frequency changer 21 of the winding spindle 14 in such a manner that the rotational speed of contact roll 5 and, thus, likewise the surface speed of package 17 remain constant despite an increasing package diameter.

When the winding spindle drive 27 is formed by an asynchronous motor, the rotational speed of the winding spindle is detected by a rotational speed sensor (not shown). The signal of the rotational speed sensor is supplied to the controller 34. The controller 34 regulates in an inner loop the rotational speed of the winding spindle to a constant value. The signal of the rotational speed sensor 35 which detects the speed of the contact roll, causes in an outer control loop a variation of the rotational speed of the winding spindle.

The second winding spindle 15 is supported off center in spindle turret 11 by means of a bearing 29 and driven by means of a winding spindle drive 28. In the illustration, the winding spindle drive 28 is deactivated, since the winding spindle 15 is on standby for replacing a full package with an empty tube 18.

The spindle turret 11 is mounted for rotation in the machine frame 9 and driven by an electric motor 40 in the direction of rotation 23. The electric motor 40 is, for example, an asynchronous motor. The electric motor 40 serves to rotate the spindle turret 11 in a direction, so as to enlarge the center distance between contact roll 5 and winding spindle 14 as the package diameter increases. To this end, the electric motor 40 is frequency-controlled via a control element 13, so that the spindle turret 11 is able to operate at any rotational speed in the direction of rotation 23. However, in connection with a polarity reversal, it would also be possible to impart to the spindle turret a rotational movement opposite to the direction of rotation 23.

As shown in FIG. 1, the contact roll 5 is mounted to a rocker arm 8, so as to enable the contact roll to perform a movement with a radial component to the winding spindle 14. The rocker arm 8 is supported for swinging movement about an axis 25 on the machine frame 9. The axis of rotation 25 is formed by a rubber block (not shown). This rubber block is rigidly secured in the machine frame. The rubber block mounts rocker arm 8, so that the rocker arm 8 is enabled to swing in a rubber-elastic manner. This rubber-elastic support has the action of a spring, which acts upon the rocker arm 8 in the sense of increasing the contact force. A pressure-relieving device 12, which can be pneumatically biased, and which acts upon the rocker arm 8 from the bottom against the weight, permits full or partial compensation of the weight that rests on the contact roll and, thus, as a contact force on the package 17, so as to enable a fine adjustment of a basic value of the desired contact force between the contact roll and the package surface. The pressure-relieving device 12 can be controlled via a control device 10. Arranged below the rocker arm 8 is a position sensor 19. The position sensor 19 registers the stroke of the contact roll 5 or the angle of traverse of the rocker arm 8 relative to the machine frame 9. It would therefore be possible to construct the sensor as an angle pickup device. The sensor 19 is connected to the control device 10. The control device 10 is further coupled with the controller 34 and the control element 13.

On the free end of rocker arm 8, which rotatably supports contact roll 5, a force sensor 41 is arranged, which serves to pick up the contact force between the contact roll 5 and the package 17. The force sensor 41 may be formed, for example, by strain gauges, which determine the bearing load of the contact roll.

The operation of the takeup machine is described in the following.

The package 17 is wound on tube 16. As the package diameter increases, the spindle turret 11 is continuously moved at a predetermined rotational speed in direction 23. The rotational speed is controlled by control element 13 and electric motor 40. To this end, the control element 13 is connected to the control device 10. In the control device 10, the momentarily wound package diameter is computed with reference to the rotational speeds of the contact roll 5 and the rotational speed for the winding spindle 14, which are supplied by controller 34. From a master curve between the package diameter and the rotational speed of the spindle turret, which is stored in the control device 10, it is possible to compute the rotational speed of the spindle turret that is associated to the momentary package diameter. The master curve is supplied to the control device 10 via an input 24. The control device 10 supplies a corresponding control signal to control element 13, so that the electric motor 40 is operated at the determined rotational speed. Once the rotational speed of the spindle turret is exactly adapted to the diameter increase, the contact roll 5 remains unchanged in its position. When the rotational speed is too slow or too high, the position of the contact roll will change. This change in position is picked up by sensor 19. The sensor 19 supplies its signal directly to the control device 10. In the control device 10, the rotational speed is now corrected such that the contact roll is moved back to its new position. Thus, the adjusted contact force between the contact roll and the package remains essentially unchanged.

With the aid of the signals supplied by controller 34, it is also possible to compute the diameter increase per unit time. With that, it is made possible to adapt the predetermined speed function to the actual diameter increase or to compute same in advance. In this case, the control device 10 is provided with a computing unit, which effects a continuous or stepwise computation of the increase in diameter, and determines a correction and advance calculation of the speed function for moving the spindle turret. This determined speed function is then used by the control device 10 as a basis for controlling the drive of the spindle turret.

However, there is also the possibility of inputting in the control device a correspondingly programmed sequence of the winding cycle in such a manner that in certain stages of the winding cycle the contact roll is deflected from its desired position. To this end a rotational speed is adjusted on the spindle turret, which is smaller than the corresponding diameter increase. This procedure makes it possible to change the contact force between the contact roll and the package. As a result of deflecting the contact roll 5 from its position, the contact force will increase due to geometrical changes. The contact force is picked up by means of the force sensor 41 and supplied to the control device. After a comparison between desired and actual values, it is thus possible to correct the speed of the evading movement continuously.

Figure 3:
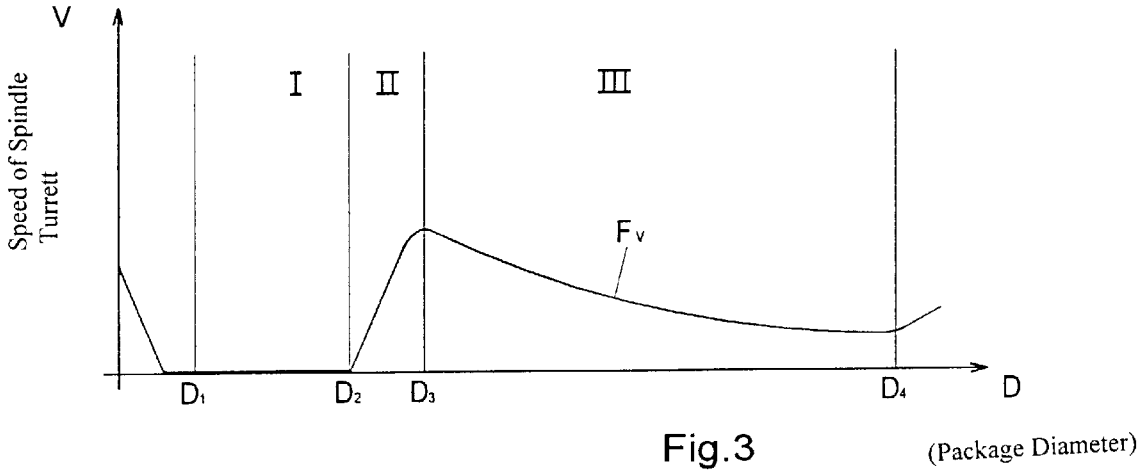
FIG. 3 is a diagram with a speed curve during the winding cycle.

The method of winding a yarn as illustrated in FIG. 3 has shown to be useful in particular in the case of a takeup machine with two winding spindles, as shown in FIGS. 1 and 2.

FIG. 3 is a diagram of a speed function $F_v$. Plotted on the abscissa is the package diameter D and on the ordinate the rotational speed v of the spindle turret. The winding cycle is essentially divided into three stages. The first stage I is the winding start range at the beginning of the winding cycle. The second stage II is the so-called range of transition, and the third stage III is the winding range. The winding start range I starts with a package diameter $D_1$. In this instance, $D_1$ is the diameter of the empty tube. This means, the yarn has just been caught on the empty tube, and the winding cycle starts. In this winding start phase I, the spindle turret is not rotated. The speed function $F_v$ shows a zero speed. Thus, the winding spindle turret 11 is stopped. The diameter increase between $D_1$ and $D_2$ is absorbed by the evading movement of the contact roll. In this phase, the contact roll is evenly rocked on rocker arm 8. After reaching the package diameter $D_2$, the electric motor of the spindle turret is activated. In this process, a steadily accelerated rotational speed is adjusted on the spindle turret. The speed function $F_v$ rises linearly. This allows to accomplish that the contact roll 5 is very rapidly returned to its initial position at the beginning of the winding cycle. This range of transition II is therefore very rapidly traversed. For the continuing course of the winding cycle, the initial position of the contact roll represents an optimal working position. At the end of the range of transition, the package diameter is $D_3$. From this point on, the rotational speed of the spindle turret is no longer accelerated. The evading movement of the winding spindle is now being adapted to the diameter increase of the package. The speed function $F_v$ shows a curve, which is substantially proportionate to the diameter increase, i.e., the speed of the spindle turret hyperbolically decreases as the package diameter increases. The rotational speed of the spindle turret which is adapted to the diameter increase is evenly decelerated. The winding cycle ends, after the package is fully wound to a maximum diameter $D_4$.

Subsequently, the yarn is transferred from the fully wound package to an empty tube. To this end, the spindle turret is rotated at an increased speed in such a manner that the second winding spindle with an empty tube thereon is moved into the path of the yarn. The winding spindle with the empty was previously driven at the speed necessary for winding. As soon as the empty tube enters with a catching slot into the yarn path, the yarn is caught on the empty tube and torn between the full package and the empty tube, so that a new winding cycle can start.

Figure 4:
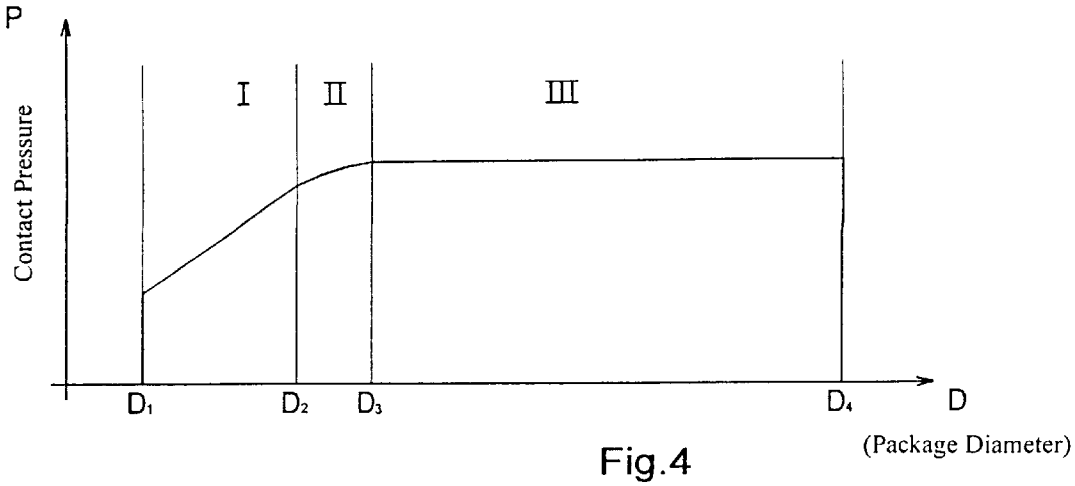
FIG. 4 is a diagram showing a course of the contact force during the winding cycle.

A further diagram is shown in FIG. 4. The package diameter is again plotted on the abscissa and the contact force P between the package and the contact roll on the ordinate. As can be noted, in the winding start range I the contact force P initially rises linearly between the diameters $D_1$ and $D_2$. The evading movement of the contact roll causes the relative position of the contact roll to the package to change continuously, so that the weight of the contact roll that acts upon the package changes, namely increases in this instance. During the simultaneous movement of the contact roll and the spindle turret, the contact force rises only slightly in the range of transition II. In the winding range III, a substantially constant contact force is reached by controlling the rotational speed of the spindle turret. In the winding range III, the speed function is determined by the predetermined contact force. With the use of a takeup machine of FIG. 1, the change in speed is disproportionate to the diameter increase, since the change in the contact force must be compensated as a result of the position change of the winding spindle. This compensation may occur by a stepwise or constant position change of the contact roll, which is controlled by the rotational speed of the spindle turret.

Figure 5:
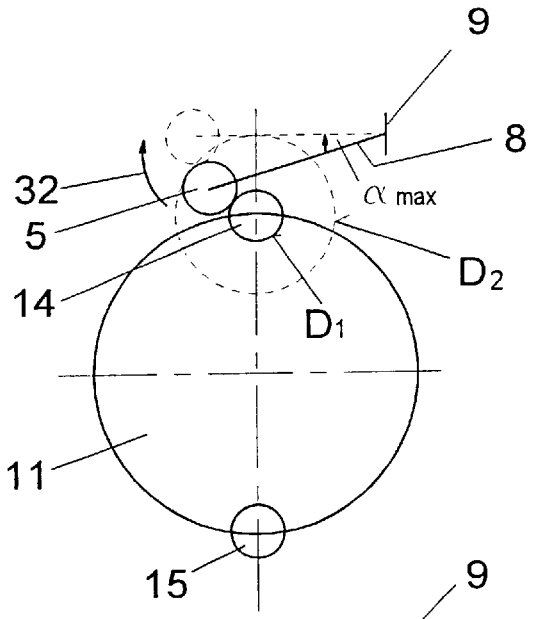
FIG. 5 is a schematic view of a takeup machine in the winding start range.
Figure 6:
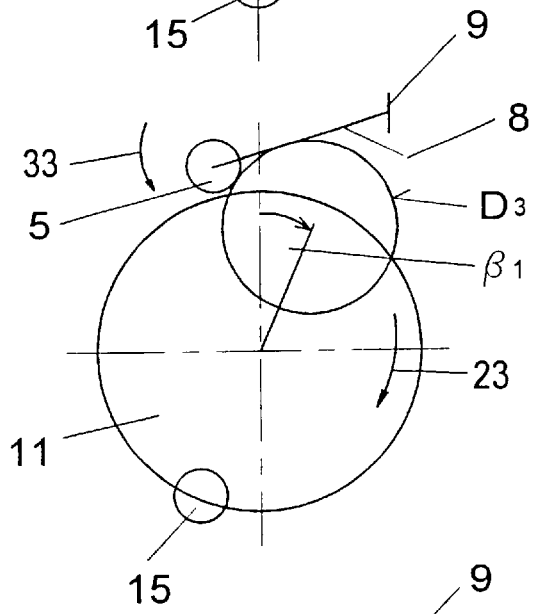
FIG. 6 is a schematic view of a takeup machine in the range of transition.
Figure 7:
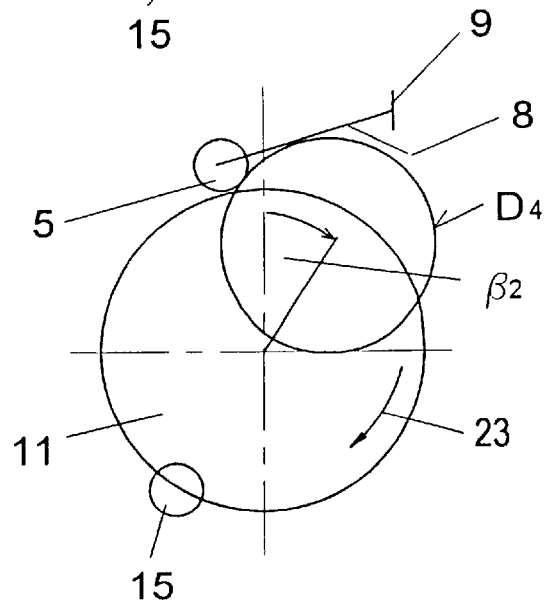
FIG. 7 is a schematic view of a takeup machine in the winding range.

In a takeup machine, the method—as has been described with reference to FIG. 3—leads to the schematic positions illustrated in FIGS. 5–7. In the winding start range (FIG. 5), the spindle turret 11 is stopped. Thus, the winding spindle 14 remains in its position. As a result, the contact roll 5 on rocker arm 8 is deflected by an angle a in the direction of movement 32, until the package diameter $D_2$ is reached, so as to yield to the increasing package diameter.

The evading movement of the contact roll may also occur, for example, by a drive 12, which engages on the rocker arm.

After the rocker arm 8 has covered a maximum angle of traverse $\alpha_{max}$, which is supplied by sensor 19 to the control device 10, the rotational drive of spindle turret 11 is activated. In so doing, the control device 10 will control the rotational drive in such a manner that the spindle turret is rotated at a maximally accelerated speed, until the contact roll 5 occupies again its initial position (FIG. 6). In this phase, the spindle turret has covered an angle of rotation $\beta_1$ in direction 23. After the contact roll has reached its initial position, and the package diameter has meanwhile increased to $D_3$, the control device 10 activates the rotational drive of spindle turret 11 in such a manner that a rotational speed dependent on the diameter increase is adjusted on the spindle turret. Thus, by the end of the winding cycle, the spindle turret has covered an angle of rotation $\beta_2$.

Based on the fact that the contact roll and the package are kept in a constant circumferential contact, it is possible to determine the respective position of the turret from the geometrical relations, namely, both from the position of the contact roll and from the momentary package diameter, or the position of the contact roll from the position of the turret and the momentary diameter of the package. It is therefore also possible to arrange a position sensor on the spindle turret, which detects the angular position of the spindle turret and supplies same to the control device. In this instance, one may do without the position sensor on the rocker arm of the contact roll.

The control of the evading movement may also proceed alone by determining the position of the contact roll and the winding spindle, since each position defines a package diameter. In this case, the control device is connected to a position sensor for the contact roll and to a position sensor for the spindle turret. The sensor signals are used to determine the momentary package diameter and the diameter increase. The diameter increase will then lead from a stored master curve to the speed of the evading movement that is to be adjusted.

The method of the present invention may be carried out not only by a takeup machine as has been described with reference to FIGS. 1 and 2, but can also be carried out with advantage by takeup machines with only one winding spindle. In this instance, the winding spindle is supported on a moveable support. The support of the winding spindle is coupled with a frequency changer-controlled drive. The support may be constructed as a rocker arm, which is unilaterally supported on the machine frame.

Likewise, the support of the winding spindle or contact roll may be constructed as a linear guideway, wherein a slide is driven by a linear drive mechanism.

Figure 8:
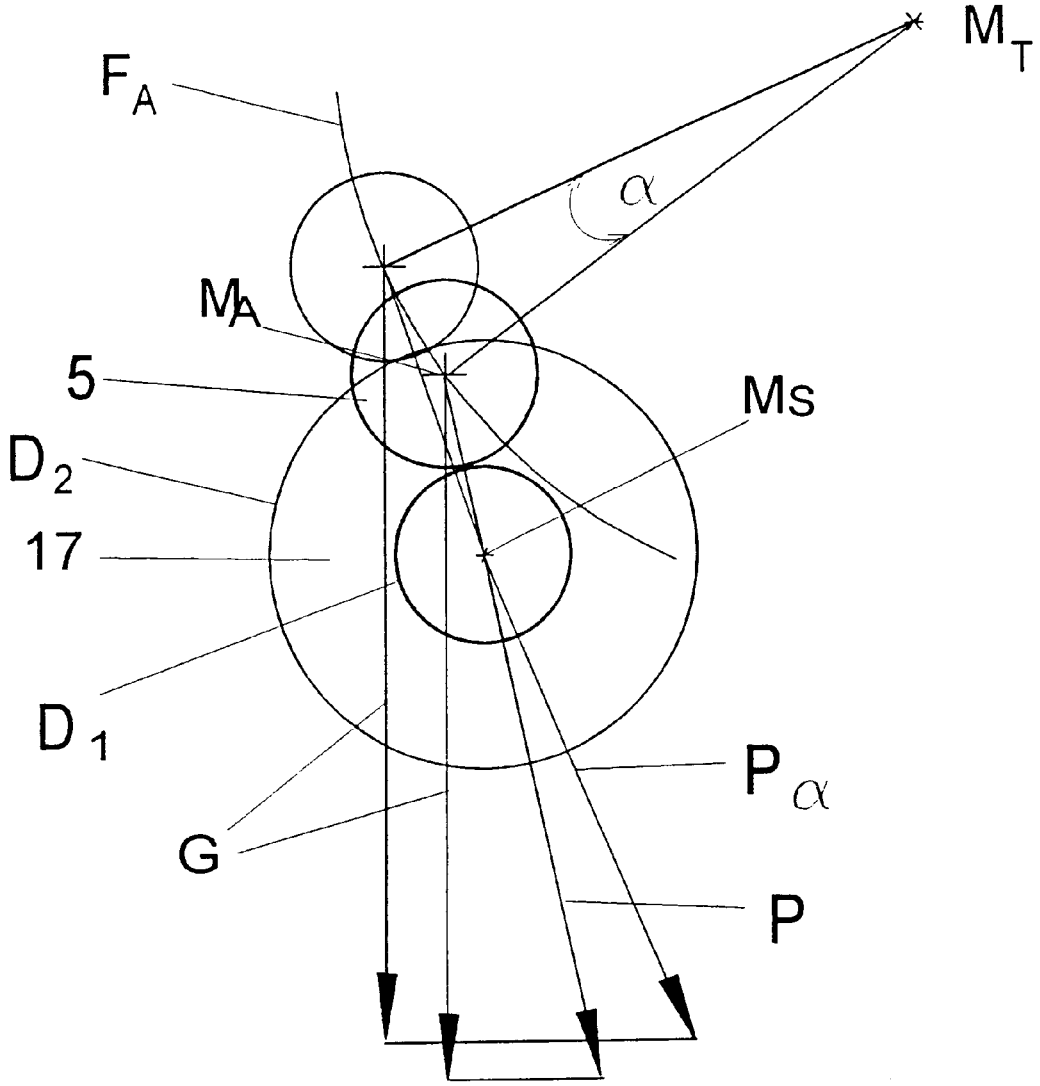
FIG. 8 is a schematic view of the relationship of forces between a contact roll and a package.

In particular, the method of the present invention is also suited to cause a change of the contact force alone by changing the rotational speeds of the support of the winding spindle or the spindle turret. The contact force that is active between the contact roll and the package results from the weight of the contact roll. FIG. 8 shows the ratio of force between the contact roll 5 and the package 17. The weight of the contact roll is indicated at G, and has a vertical active direction. The contact force P which is active between the contact roll and the package 17, has an active direction along the connection line between the axis center $M_A$ of the contact roll and the axis center $M_S$ of the winding spindle. In this phase the package has the diameter $D_1$. In the course of the winding cycle, the package 17 increases from diameter $D_1$ to diameter $D_2$. In so doing, the position of the winding spindle is not changed. However, the axis center $M_A$ of the contact roll will move along a circular guide path $F_A$, the center of which is formed by the axis center $M_T$ of the axis of rotation of the support or the rocker arm. The support or the rocker arm of the contact roll is thus displaced by the angle $\alpha$. Since the weight G of the contact roll remains unchanged, the changed angular position will result in a contact force $P_\alpha$ that is active between contact roll 5 and package 17. Thus, the takeup machine of the present invention offers the possibility of adjusting, merely by changing the position of the contact roll, a contact force that is desirable for the formation of the package. In this instance, a biasing force could be used to increase or relieve the weight G of the contact roll by a constant value depending on requirements. Once a contact force that is desired for the package formation is adjusted by changing the position of the contact roll, the contact roll will remain in its position by removing the winding spindle by means of the spindle turret.

To obtain, for example, in the winding range, a change of the contact force that is produced by the speed of the spindle turret, it is possible to stop or decelerate the speed of the spindle turret for a short time, so that the diameter increase leads to a change in position of the contact roll. As soon as the contact roll reaches the position that is required for the contact force, the speed of the spindle turret is raised to the value proportionate to the diameter increase. Likewise, it is possible to increase the speed of the spindle turret such that it is greater than the speed necessary for the diameter increase. In this phase, the contact roll is deflected in opposite direction. As soon as the desired contact force between the contact roll and the package is reached, the speed is readjusted to the value proportionate to the diameter increase. This results in a high flexibility in the buildup of the package.

Likewise, it would be possible to carry out a constant regulation of the rotational speed of the support or the spindle turret, in that a sensor picks up the speed of the evading movement and supplies same as an actual value to the control device. Thus, it is possible to conduct in the control device a constant correction of the speed based on a comparison between actual and desired values.

Figure 9:
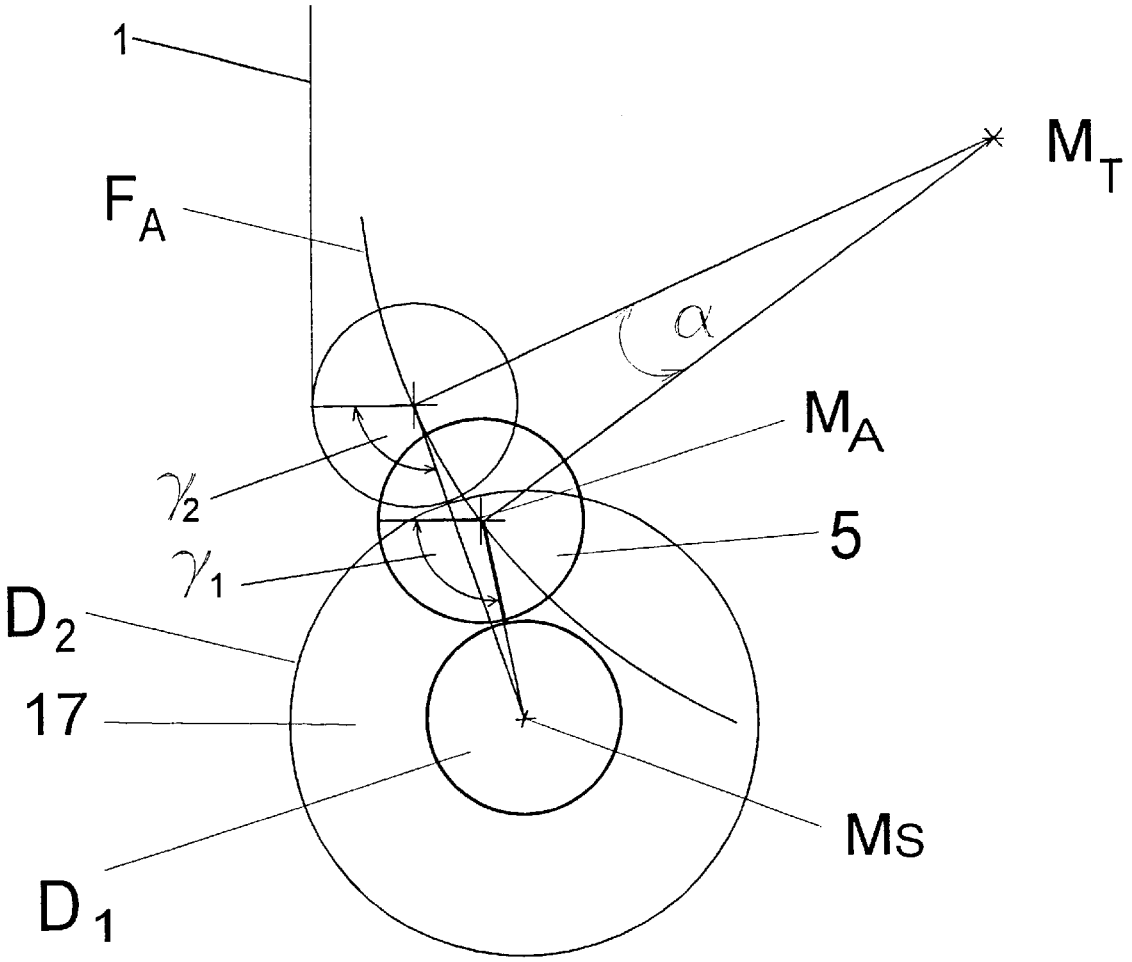
FIG. 9 is a schematic view of the contact roll in two different positions.

The method of the present invention may also be used with advantage to change the looping of the yarn on the contact roll during a winding cycle. To this end, the contact roll is shown in FIG. 9 in two different positions. For example, the contact roll may be guided by a rocker arm, which is supported for rotation about an axis MT. In the lowest position of the contact roll, a package with the diameter $D_1$ is wound on the winding spindle. In the upper position of the contact roll, the package on the winding spindle increased to the diameter $D_2$.

The contact roll and the winding spindle are located with respect to the yarn path in such a manner that a yarn 1 advancing onto the surface line of the contact roll is deposited on the package being wound only after partially looping about the contact roll. The looping range of the yarn 1 on the contact roll is indicated in the Figure by an angle $\gamma$. This partial length of the circumference is also named a so-called print length. The print length has a significant influence on the package buildup. To realize an undisturbed buildup of the package, a minimum print length is needed on the contact roll.

In FIG. 9, the looping angle of the contact roll in the lower position is indicated at $\gamma_1$. The looping angle in the upper position of the contact roll is indicated at $\gamma_2$. The looping angle $\gamma_2$ is smaller than the looping angle $\gamma_1$. Thus, the print length can be influenced merely by changing the position of the contact roll. In particular, in the case of a winding spindle that is guided by the spindle turret, the print length will increase as the center distance between the winding spindle and the contact roll becomes larger. Such a change in the print length may be compensated by an intermediate position change of the contact roll. This allows to determine the speed of the spindle turret even as a function of a print length that is to be maintained on the contact roll.

Likewise, the method of the present invention may advantageously be used with a takeup machine, which has a stationary contact roll and a winding spindle mounted to a movable support. In this instance, the position of the support is sensed and supplied to a control device. The control device will then determine from the speeds of the contact roll and the winding spindle the momentary package diameter and, thus, the diameter increase, and it will control the drive of the support in such a manner that the support performs an evading movement at a defined speed.

What is claimed is:

1. A method of winding a continuously advancing yarn to form a yarn package, comprising the steps of winding the advancing yarn onto a tube which is coaxially mounted on a driven winding spindle which in turn is mounted on a moveable support, and so as to form a yarn package, engaging the circumferential surface of the package with a contact roll which is mounted on a second moveable support so that a contact force between the contact roll and the surface of the package can be varied by the position of the contact roll relative to the package, and controlling the center to center distance between the winding spindle and the contact roll to accommodate the increasing diameter of the package and including, during at least a portion of the winding of the package, controlling an evading movement of the winding spindle which increases the center to center distance at a continuous, smooth speed profile which decreases as the diameter of the yarn package increases and which is determined as a function of a predetermined speed function which relates the speed of the evading movement to the momentary package diameter.

2. The method as defined in claim 1 wherein the speed of the evading movement as determined by the predetermined speed function is proportionate to the diameter increase of the package and so that while the package builds the position of the contact roll remains substantially unchanged.

3. The method as defined in claim 1 wherein the speed of the evading movement as determined by the predetermined speed function is disproportionate to the diameter increase of the package and so that while the package builds the position of the contact roll changes.

4. The method as defined in claim 1 wherein the step of controlling the evading movement of the winding spindle is also a function of the winding time.

5. The method as defined in claim 1 wherein the package diameter is determined by the position of the second moveable support mounting the contact roll or the position of the moveable support mounting the winding spindle.

6. The method as defined in claim 1 wherein the package diameter is determined from the ratio of the rotational speed of the contact roll and the rotational speed of the winding spindle.

7. The method as defined in claim 1 wherein the speed of the evading movement is computed in advance from a parameter characterizing the chronological diameter increase of the package and the package diameter.

8. The method as defined in claim 7 wherein the parameter is determined during the winding cycle while the moveable support of the winding spindle is stopped.

9. The method as defined in claim 1 wherein the speed of the evading movement is computed in advance from a parameter characterizing the chronological diameter increase of the package, the package diameter, and the position of the contract roll.

10. The method as defined in claim 9 wherein said parameter includes the contact force between the contact roll and the package which is determined from the relative position of the contact roll to the package, while the moveable support of the winding spindle is stopped.

11. The method as defined in claim 1 wherein the step of controlling the evading of the winding spindle includes determining the predetermined speed function as a function of the winding time and without the use of any sensors which monitor the speed of the winding spindle or the contact roll.

12. A method of winding a continuously advancing yarn to form a yarn package on a winding spindle, comprising the steps of controlling the winding process so as to include (1) a winding start range at the beginning of the winding cycle wherein a movable support for the winding spindle is stationary and a contact roll is caused to move out of an initial position by the build of the package, (2) a transition range wherein the movable support for the winding spindle is moved so as to cause the contact roll to return to its initial position, and (3) a winding range wherein the movable support for the winding spindle is moved at a continuous, smooth speed profile which decreases as the diameter of the yarn package increases to accommodate the build of the package in accordance with a predetermined speed function which relates the speed of the movement to the momentary package diameter.

13. The method as defined in claim 12 wherein the moveable support of the winding spindle comprises a rotatable spindle turret which mounts a second winding spindle, and wherein each winding spindle may be alternately moved between a winding position and a doffing position by rotation of the turret.

14. The method as defined in claim 12 wherein during the winding start range, the value of the contact force is determined as a function of the position of the contact roll, and wherein the speed of the movement of the winding spindle during the winding range is modified as a function of a comparison between the actual value of the contact force and a desired value.

15. The method as defined in claim 12 wherein the speed of movement of the winding spindle during the winding range is computed in advance from the winding parameters present during the winding start range.

16. The method as defined in claim 12 wherein the movement of the winding spindle is carried out by a variable speed drive of the support of the winding spindle.

17. An apparatus for winding a continuously advancing yarn to form a yarn package, comprising a winding spindle mounted on a moveable support and adapted for coaxially receiving a tube upon which the yarn package is wound, a contact roll mounted on a second moveable support so as to lie in contact with the surface of the package, a drive for moving the movable support for the winding spindle in an evading movement away from the contact roll, a control device for controlling the drive so as to vary the center to center distance between the winding spindle and the contact roll, and which includes an input connected to the drive for receiving a predetermined speed function which relates the speed of movement of the winding spindle to the momentary package diameter, and a controller connected to the input for determining the momentary package diameter or the winding time, so that the drive is activatable by the control device to increase the center to center distance at a continuous, smooth speed profile which decreases as the diameter of the yarn package increases and as a function of the predetermined speed function.

18. The apparatus as defined in claim 17 wherein the control device includes a position sensor for determining the momentary position of the contact roll or the winding spindle.

19. The apparatus as defined in claim 18 wherein said second moveable support is in the form of a rocker arm which is pivotally mounted to a machine frame, and wherein the position sensor comprises an angle pick-up device for determining the angular traverse of the rocker arm.

20. The apparatus as defined in claim 17 wherein the control device is connected to a force sensor for determining the contact force between the contact roll and the package, and wherein the control device includes a storage unit for storing the actual value of the contact force as a function of the position of the contact roll.

21. The apparatus as defined in claim 17 wherein said second moveable support includes a second drive which is controlled by the control device.

22. The apparatus as defined in claim 17 wherein the moveable spindle support comprises a turret mounted for rotation about an axis parallel to but laterally offset from the axis of the winding spindle.

* * * * *

UNITED STATES PATENT AND TRADEMARK OFFICE
CERTIFICATE OF CORRECTION

PATENT NO. : 6,105,896

DATED : August 22, 2000

INVENTOR(S) : Westrich

It is certified that error appears in the above-identified patent and that said Letters Patent is hereby corrected as shown below:

Title page, item [86], in the filing details, the § 371 date and § 102 (e) date, "April 19, 1998" should read --Apr. 19, 1999--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*